US007980017B2

(12) United States Patent
Harman, III

(10) Patent No.: US 7,980,017 B2
(45) Date of Patent: Jul. 19, 2011

(54) ADJUSTABLE GUN VISE

(76) Inventor: James Pope Harman, III, Greenville, GA (US)

( * ) Notice: Subject to any disclaimer, the term of this patent is extended or adjusted under 35 U.S.C. 154(b) by 307 days.

(21) Appl. No.: 12/178,871

(22) Filed: Jul. 24, 2008

(65) Prior Publication Data

US 2009/0026679 A1 Jan. 29, 2009

Related U.S. Application Data

(60) Provisional application No. 60/951,800, filed on Jul. 25, 2007.

(51) Int. Cl.
*F41C 27/00* (2006.01)
*F41A 23/06* (2006.01)

(52) U.S. Cl. ..... 42/94; 89/37.04; D8/74

(58) Field of Classification Search ..... 42/94; 89/37.04; 269/43, 71, 74; D8/74
See application file for complete search history.

(56) References Cited

U.S. PATENT DOCUMENTS

| | | | | | |
|---|---|---|---|---|---|
| 499,315 | A * | 6/1893 | Borchardt | 89/132 |
| 2,106,525 | A * | 1/1938 | Henry | 269/70 |
| 2,427,365 | A * | 9/1947 | Meister | 269/152 |
| 2,669,958 | A * | 2/1954 | Sweeney | 269/45 |
| 3,358,504 | A * | 12/1967 | Freebairn | 73/167 |
| 3,495,795 | A * | 2/1970 | Brown | 248/230.5 |
| 4,007,554 | A * | 2/1977 | Helmstadter | 42/94 |
| 4,012,860 | A * | 3/1977 | Auger | 42/94 |
| 4,145,006 | A * | 3/1979 | Webb | 269/69 |
| 4,613,120 | A * | 9/1986 | Kozar | 269/71 |
| 4,621,563 | A * | 11/1986 | Poiencot | 89/37.04 |
| 4,819,359 | A * | 4/1989 | Bassett | 42/94 |
| 4,915,273 | A * | 4/1990 | Allen | 224/462 |
| 5,347,740 | A * | 9/1994 | Rather et al. | 42/94 |
| 5,937,561 | A * | 8/1999 | Abernethy | 42/94 |
| 6,293,041 | B2 * | 9/2001 | Weaver | 42/94 |
| 6,978,989 | B2 * | 12/2005 | Glaser et al. | 269/71 |
| 7,406,794 | B1 * | 8/2008 | Pope, Jr. | 42/94 |
| 2006/0038334 | A1 * | 2/2006 | Glaser et al. | 269/71 |
| 2006/0248775 | A1 * | 11/2006 | Wade et al. | 42/94 |
| 2008/0106020 | A1 * | 5/2008 | Sherlock | 269/71 |
| 2009/0278296 | A1 * | 11/2009 | Fulcher et al. | 269/60 |
| 2009/0302517 | A1 * | 12/2009 | Patel | 269/71 |

* cited by examiner

*Primary Examiner* — Bret Hayes
(74) *Attorney, Agent, or Firm* — Sutherland Asbill & Brennan LLP

(57) ABSTRACT

A gun vise for adjustably holding a gun on a mounting surface includes a coupling component, a mounting component, a horizontal adjustment mechanism, and a vertical adjustment mechanism. The coupling component is configured to couple a gun to the gun vise. The mounting component is configured to secure the gun vise to a mounting surface. The horizontal adjustment mechanism is configured to adjust a position of the coupling component in a first direction. The vertical adjustment mechanism is configured to adjust a position of the coupling component in a second direction.

21 Claims, 8 Drawing Sheets

ADJUSTABLE GUN VISE

CROSS-REFERENCE TO RELATED APPLICATION

This application claims the benefit of U.S. Provisional Application No. 60/951,800 entitled "Adjustable Gun Vise", which was filed on Jul. 25, 2007 and is incorporated by reference in its entirety.

TECHNICAL FIELD

The present application generally relates to a gun vise and more particularly relates to a gun vise that can be adjusted.

BACKGROUND

Shooting guns is a popular activity. Usually, the gun is aimed at a target and the gun is fired. If the gun is aimed properly and is held steady as the gun is fired, the target may be struck. Otherwise, the target may be missed. Thus, the enjoyment associated with shooting the gun may vary according to the ability of the shooter to aim the gun and to hold the gun steady.

Some shooters may find it difficult to aim the gun or to hold the gun steady after the gun is aimed. For example, it may be difficult for the shooter to support the weight of the gun while maintaining the aim, especially if the shooter is small or inexperienced. Further, it may be difficult for shooters of all experience levels to maintain the aim of the gun, which may diminish the likelihood of striking the target, especially targets that are located at a distance. Even if the gun is properly aimed and is held steady, the recoil of the gun shot may decrease the accuracy of the shot. Further, the recoil may be uncomfortable for the shooter.

In some cases, the gun may be attached to a gun vise or a gun rest, which in turn is attached to a physical structure, such as a railing on a hunting stand. The gun vise may hold the gun steady and may reduce the effect of the recoil on the shooter. However, most gun vises have a limited range of motion. Therefore, when the gun is positioned in the gun vise, the shooter can aim at some targets but not others.

From the above, it is apparent that a need exists for a gun vise that addresses the inadequacies and deficiencies mentioned above.

SUMMARY

A gun vise for adjustably holding a gun on a mounting surface includes a coupling component, a mounting component, a horizontal adjustment mechanism, and a vertical adjustment mechanism. The coupling component is configured to couple a gun to the gun vise. The mounting component is configured to secure the gun vise to a mounting surface. The horizontal adjustment mechanism is configured to adjust a position of the coupling component in a first direction. The vertical adjustment mechanism is configured to adjust a position of the coupling component in a second direction.

Other systems, devices, methods, features, and advantages of the disclosed adjustable gun vise will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE FIGURES

The present application may be better understood with reference to the following figures. Matching reference numerals designate corresponding parts throughout the figures, and components in the figures are not necessarily to scale.

DETAILED DESCRIPTION

Described below are embodiments of a gun vise. The gun vise may be adapted for releasably securing a gun, such as a rifle, to a mounting surface, such as a deck rail or a deer stand. Specifically, the gun may be secured to the gun vise, and the gun vise may be secured to the mounting surface. When so secured, the gun vise may assist in maintaining the aim of the gun as the gun is fired. The gun vise also may be adjusted, so that the aim of the gun may be allowed a range of motion, such as vertical and horizontal motion, even after the gun is secured to mounting surface using the gun vise.

Figure 1:
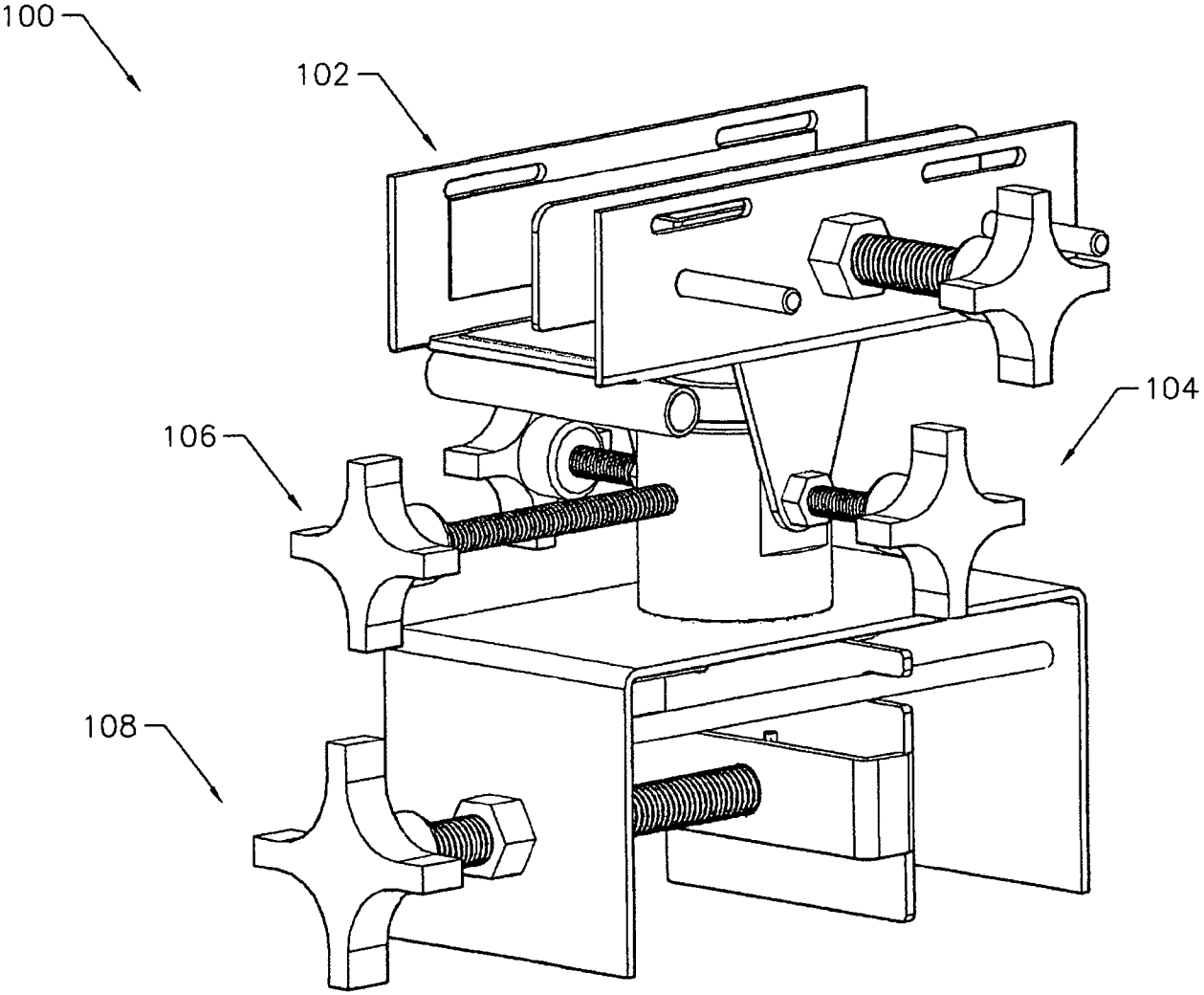
FIG. 1 is a perspective view of an embodiment of a gun vise.

FIG. 1 is a perspective view of an embodiment of a gun vise 100 and components thereof. The gun vise 100 generally includes a coupling component 102 that may releasably secure a gun to the gun vise 100 and a mounting component 108 that may releasably secure the gun vise 100 to a mounting surface. Thereby, the gun vise 100 may be adapted for securing a gun against a mounting surface, so that the aim of the gun may be maintained as the gun is fired.

The gun vise 100 also generally includes adjustment mechanisms that may be adjusted to vary an aim of the gun. Specifically, a vertical adjustment mechanism 104 may be adjusted to vary an aim of the gun in a vertical direction, and a horizontal adjustment mechanism 106 may be adjusted to vary an aim of the gun in a horizontal direction. More particularly, the adjustment mechanisms 104, 106 may vary a position of the coupling component 102 with reference to the mounting component 108. Thus, the aim of a gun secured in the coupling component 102 may be varied with reference to the mounting component 108 and the associated mounting surface.

Figure 2:
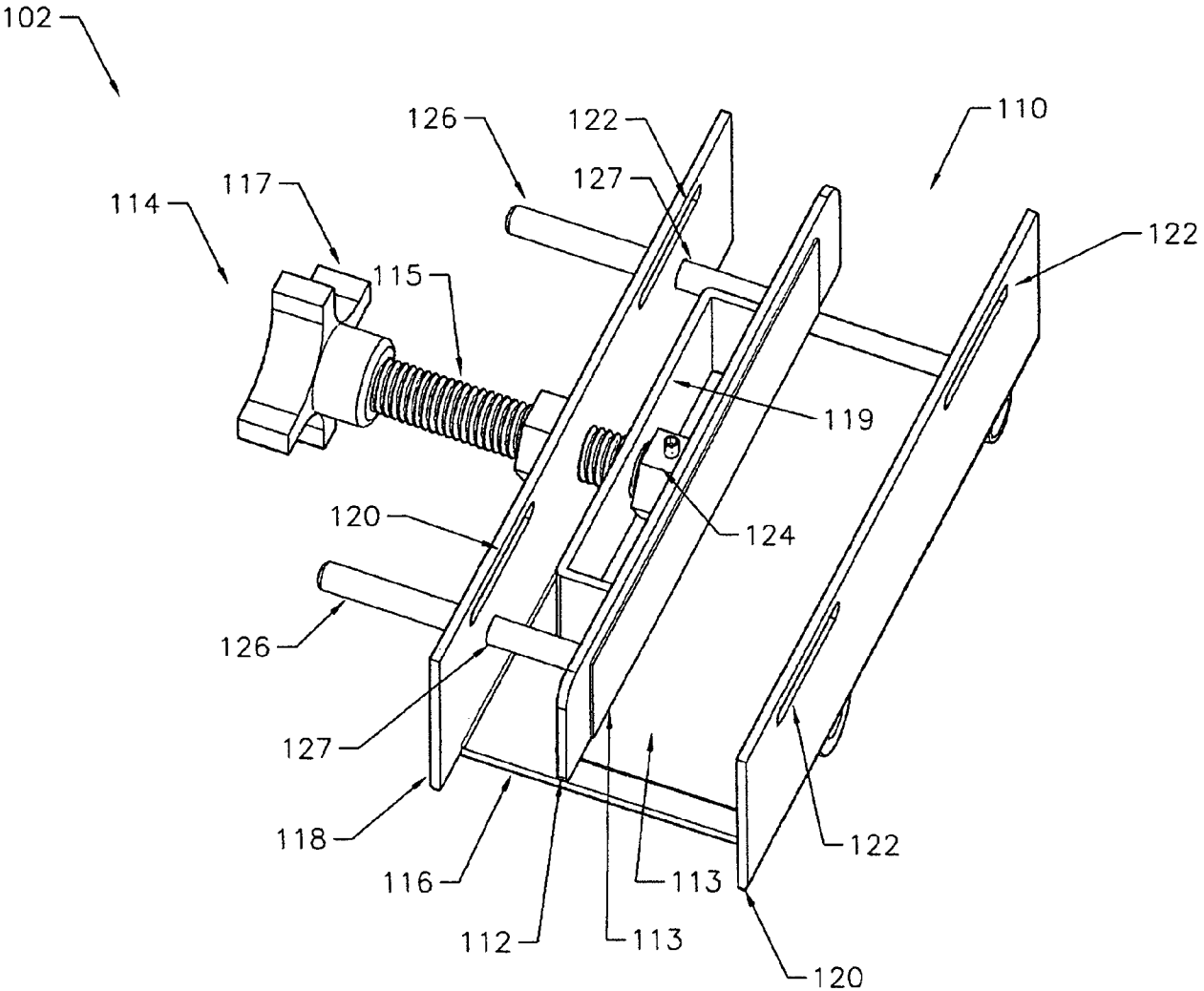
FIG. 2 is a partial perspective view of the gun vise shown in FIG. 1, illustrating an embodiment of a coupling component.

FIG. 2 is a perspective view of an embodiment of the coupling component 102. As mentioned above, the coupling component 102 may releasably secure a gun to the gun vise 100. For example, the coupling component 102 may be suited for securing a relatively long gun, such as a rifle, to the gun vise 100. As shown, the coupling component 102 generally includes a supporting body 110 and an adjustable securing plate 112. The supporting body 110 may be sized and shaped to support the gun. When the gun is so supported, the adjustable securing plate 112 may be moved via an adjustor 114 to releasably secure the gun within the supporting body 110.

As shown, the supporting body 110 may include a lower plate 116, a reference side plate 118, and a stationary securing side plate 120. The plates 116, 118, and 120 may be positioned so that when the gun is positioned in the gun vise 100, the gun may rest on the lower plate 116 between the side plates 118, 120. The adjustable securing plate 112 may be positioned between the reference side plate 118 and the stationary securing side 120.

To tighten or release the adjustable securing plate 112, the adjustor 114 may be coupled to the adjustable securing plate 112. In the illustrated embodiment, the adjustor 114 may have a threaded shaft 115 associated with a knob 117. The threaded shaft 115 may extend from the knob 117 through the reference side plate 118, and through a bracket 119 coupled to the adjustable securing plate 112. A stop 124 may be positioned on the threaded shaft 115 between the bracket 119 and the adjustable securing plate 112. The stop 124 may span the distance between the bracket 119 and the adjustable securing plate 112.

In use, the stop 124 may transfer movement of the adjustor 114 to the adjustable securing plate 112, so that the adjustable securing plate 112 may be released or tightened. When the adjustable securing plate 112 is tightened, the gun may be secured between the adjustable securing plate 112 and the stationary securing plate 120. When the adjustable securing plate 112 is released, the gun may be removed from the gun vise 100. To tighten the adjustable securing plate 112 against the gun, the knob 117 may be turned to rotate the threaded shaft 115 toward the stop 124. The stop 124 may exert a force on the adjustable securing plate 112 to push the adjustable securing plate 112 toward the stationary securing side plate 120. To release the adjustable securing plate 112, the knob 117 may be turned to rotate the threaded shaft 115 away from the stop 124. The stop 124 may exert a force on the bracket 119, and the bracket 119 may pull the adjustable securing plate 112 toward the reference side plate 118.

As shown in the illustrated embodiment, the stop 124 may be a nut positioned on the threaded shaft 115. For example, the nut may be welded onto the threaded shaft 115. The nut also may be removable, so that the adjustor 114 and the adjustable securing plate 112 can be removed from the gun vise 100. The stop 124 may also have other configurations. Further, the bracket 119 may be omitted, in which case the adjustor 114 may be directly coupled to the adjustable securing plate 112. In such case, movement of the adjustor 114 may be directly transferred to the securing member 112. For example, the adjustor 114 may translate with reference to the supporting body 110. A range of other configurations are also possible.

In embodiments, cushioning pads 113 may be positioned about the supporting body 110. The cushioning pads 113 may absorb vibration to further stabilize the gun within the supporting body 110. Thereby, the cushioning pads 113 may increase the accuracy of the shot. The cushioning pads 113 also may protect the gun from damage due to interaction with the surrounding plates 112, 116, 120. As shown, the cushioning pads 113 may be positioned on one or more of the adjustable securing plate 112, the stationary securing side plate 120, and the lower plate 116.

In embodiments, the adjustable securing plate 112 may be configured to maintain its alignment with reference to the reference side plate 118. For example, one or more aligning rods 126 may extend from the adjustable securing plate 112 through apertures 127 in the reference side plate 118. As the adjustable securing plate 112 moves, the aligning rods 126 may slide in the apertures 127 to maintain the general alignment of the adjustable securing plate 112 with reference to the reference side plate 118. Other aligning configurations are possible in other embodiments.

In embodiments, the supporting body 110 also may include a number of opposed strap slots 122. The strap slots 122 may be formed through the side plates 118, 120. Once the gun is securely positioned in the supporting body 110, a strap may be passed through the opposed strap slots 122. The straps may be tightened to further secure the gun to the gun vise 100.

With reference back to FIG. 1, the gun vise 100 may include a vertical adjustment mechanism 104 and a horizontal adjustment mechanism 106. The vertical adjustment mechanism 104 may be used to adjust the position of the coupling component 102 in the vertical direction and the horizontal adjustment mechanism 106 may be used to adjust the position of the coupling component 102 in the horizontal direction. Therefore, when a gun is positioned in the coupling component 102, the aim of the gun may be adjusted by adjusting the relative position of the coupling component 102.

It should be noted that the terms "vertical direction" and "horizontal direction" are generally described with reference to the mounting surface to which the gun vise is mounted, and not with reference to the ground. When the mounting surface is parallel to the ground, the vertical direction may be generally transverse to the ground and the horizontal direction may he generally coincident with the ground. However, when the mounting surface forms an angle with the ground, the vertical and horizontal directions may also form corresponding angles with the ground.

Further, it should be noted that the vertical direction may not be perpendicular to the mounting surface and the horizontal direction may not be parallel to the mounting surface. The vertical direction may have a component that is perpendicular to the mounting surface and a component that is parallel to the mounting surface, the perpendicular component being relatively larger than the parallel component. Likewise, the horizontal direction may have a component that is parallel to the mounting surface and a component that is perpendicular to the mounting surface, the parallel component being relatively larger than the perpendicular component. Also, the vertical direction and the horizontal direction need not be perpendicular to each other.

Figure 3:
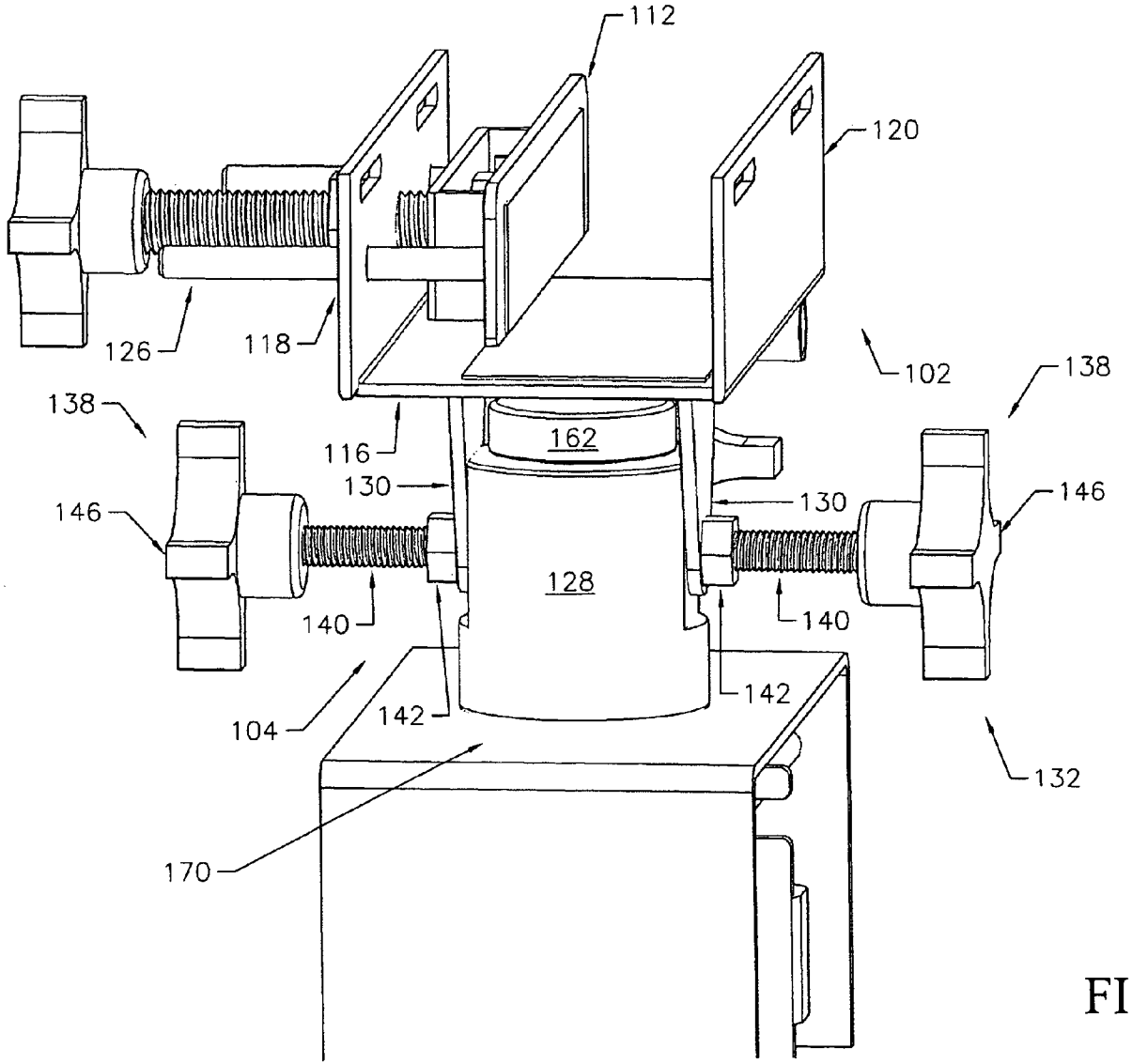
FIG. 3 is a partial side view of the gun vise shown in FIG. 1, illustrating an embodiment of a vertical adjustment mechanism.

FIG. 3 is a partial side view of the gun vise 100, illustrating an embodiment of the vertical adjustment mechanism 104. The vertical adjustment mechanism 104 may permit varying the orientation of the coupling component 102 in the vertical direction. As shown, the vertical adjustment mechanism 104 may include an adjustment hub 128 associated with the mounting component 108 and one or more flanges 130 associated with the coupling component 102. The adjustment hub 128 may remain stationary in the vertical direction, while the flanges 130 may rotate with reference to the adjustment hub 128 to vary the orientation of the coupling component 102 in the vertical direction. A tightening device 132 may be configured to secure the flanges 130 to the adjustment hub 128 once the coupling component 102 has been positioned in the desired vertical orientation. More specifically, when the tightening device 132 is loosened, the flanges 130 may be permitted to rotate with reference to the adjustment hub 128 to adjust the orientation of the coupling component 102 in the vertical direction. When the tightening device 132 is tightened, the flanges 130 may be prevented from rotating to secure the coupling component 102 in a selected vertical orientation.

In the illustrated embodiment, a pair of flanges 130 may extend downward from an underside of the coupling component 102. The flanges 130 may be spaced apart from each other by a distance that is slightly greater than a width of the adjustment hub 128, so that the flanges 130 may be placed about the adjustment hub 128. Each flange 130 may have an opening that is sized and positioned to align with a corresponding threaded aperture 136 on the adjustment hub 128. (The threaded apertures 136 are visible in FIG. 4). The tightening device 132 may include two tightening knobs 138, each tightening knob 138 having a knob 146, a threaded shaft 140, and a stop 142. The stop 142 may be spaced slightly inward from an end of the threaded shaft 140 opposite from the knob 146.

In use, the tightening knobs 138 may be placed on opposite sides of the adjustment hub 128. The end of threaded shaft 140 may be passed through the opening on the flange 130 and into the threaded aperture 136 on the adjustment hub 128, so that the flanges 130 become captured between the stops 142 and the adjustment hub 128. The flanges 130 may be capable of rotating about the threaded shafts 140, which may rotate the coupling component 102. Once the coupling component 102 is positioned in the desired vertical orientation, the tightening knobs 138 may be rotated to move the stops 142 inward. The flanges 130 may be captured between the stops 142 and the adjustment hub 128. The stops 142 may apply a load to the flanges 13O to maintain the coupling component 102 in the selected vertical orientation. To re-adjust the vertical orientation, the tightening knobs 138 may be rotated to move the stops 142 outward so that the flanges 130 are permitted to rotate about the threaded shafts 140.

In embodiments, the adjustment hub 128 may have relatively planar outer surfaces 137 adjacent to the threaded apertures 136. (The relatively planar outer surfaces are visible in FIG. 4.) The relatively planar outer surfaces 137 may facilitate applying a relatively larger and more even load on the flanges 130 using the stops 142. Thereby, the coupling component 102 may be further prevented from rotating out of the selected vertical position. The adjustment hub 128 may otherwise have a variety of shapes. For example, the illustrated adjustment hub 128 may have may have a relatively cylindrical outer surface.

In embodiments, the tightening device 132 may be configured for one-handed operation. In cases in which the tightening device 132 includes two tightening knobs 138, as shown one-handed operation may be enabled by tightening only one of the tightening knobs 138 while allowing the other tightening knob 138 to remain loosened. Tightening only one of the tightening knobs 138 may be sufficient to secure the coupling component 102 in the desired vertical orientation while enabling the user to subsequently change the vertical orientation using only one hand. For example, a right-handed user may use his right-hand to tighten only one of the tightening knobs 138. The one tightened knob 138 may maintain the vertical orientation of the coupling component 102. The one loosened knob 138 permits changing the vertical orientation. Thereafter, the right-handed user can change the vertical orientation of the coupling component 102 by loosening the one tightened knob 138 with his right hand. Because the other tightening knob 138 was not tightened, the right-handed user need not loosen this knob 138 to change the vertical orientation of the coupling component 102.

In other embodiments, the tightening device 132 may include only one tightening knob 138. The tightening knob 138 may be positioned on either the left or right side of the adjustment hub 128. The location of the tightening knob 132 may also be configurable by the user, depending on his preference. For example, the user may alter the location of the tightening knob 138 by reversing the orientation of the coupling component 102, as described below, or by removing the tightening knob 138 from one threaded aperture 136 and placing the tightening knob 138 in the threaded aperture 136 on the opposite side of the gun vise 100.

With reference back to FIG. 4, in embodiments, the adjustment hub 128 may be removably coupled to the mounting component 108 using a fastener 162. The fastener 162 may hold the adjustment hub 128 stationary in the vertical direction. The fastener 162 also may enable removing the adjustment hub 128 from the mounting component 108, for reasons described below.

In embodiments, the coupling component 102 may be removable from the adjustment hub 128. For example, the threaded shafts 140 may be completely removed from the threaded apertures 136 and the flanges 130. Removing the coupling component 102 permits reversing the orientation of the coupling component 102 with reference to the adjustment hub 128, so that the position of the adjustor 114 can be varied. For example, a right-handed shooter may prefer for the adjustor 114 to be positioned on the left side of the coupling component 102, so that the adjustor 114 is out of the line of sight when the gun is aimed. Similarly, a left-handed shooter may prefer for the adjustor 114 to be positioned on the right side of the coupling component 102.

Figure 4:
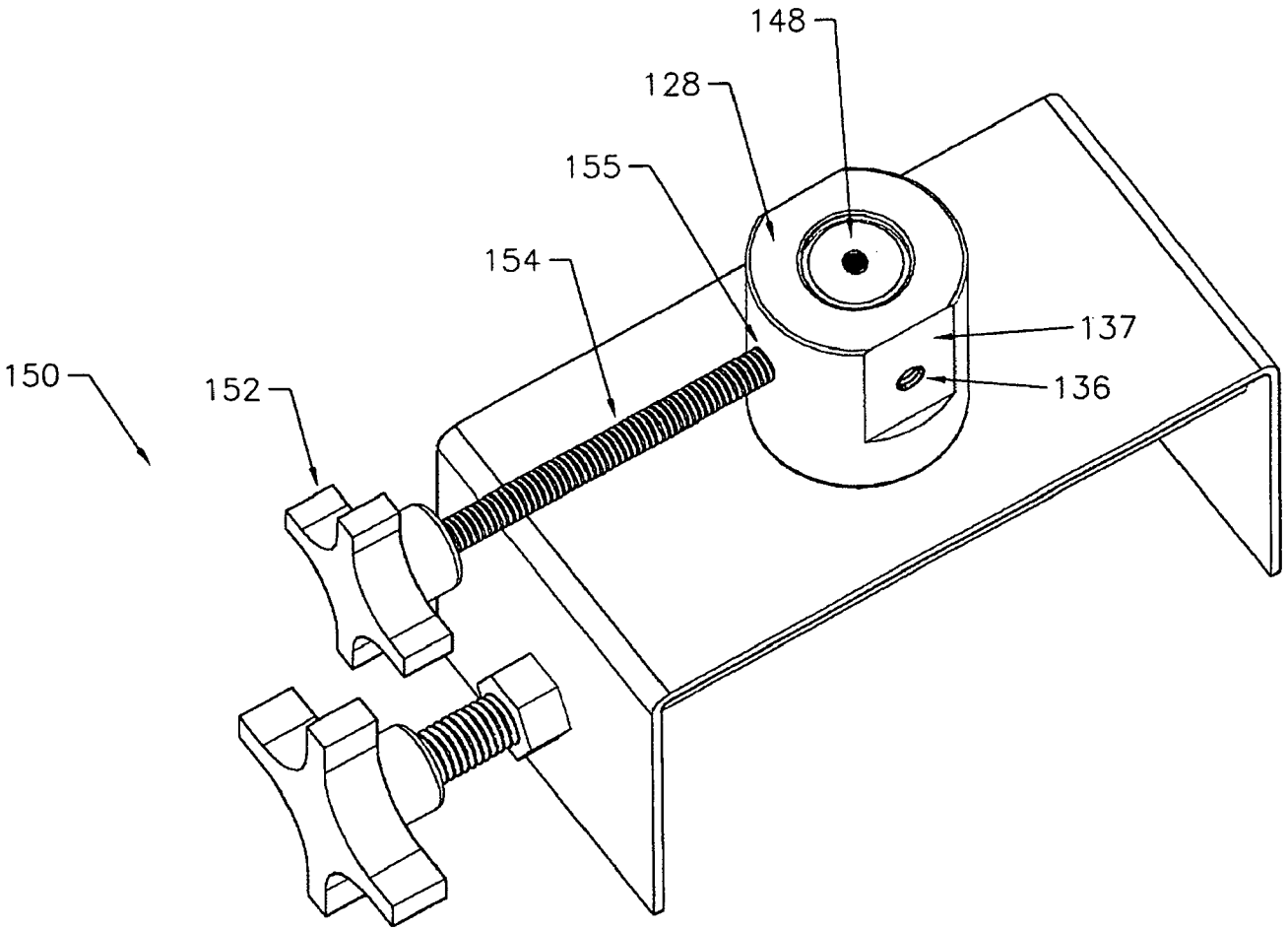
FIG. 4 is a partial perspective view of the gun vise shown in FIG. 1, illustrating an embodiment of a horizontal adjustment mechanism.

FIG. 4 is a partial perspective view of the gun vise shown in FIG. 1, illustrating an embodiment of a horizontal adjustment mechanism. The horizontal adjustment mechanism 106 may permit varying the orientation of the coupling component 102 in the horizontal direction. As shown, the horizontal adjustment mechanism 106 may include a fixed hub 148, the adjustment hub 128, and a set screw 150. The fixed hub 148 may be fixed in the horizontal direction, while the adjustment hub 128 may be rotatable about the fixed hub 148 in the horizontal direction. The set screw 150 may releasably secure the adjustment hub 128 in a selected horizontal orientation.

Figure 5:
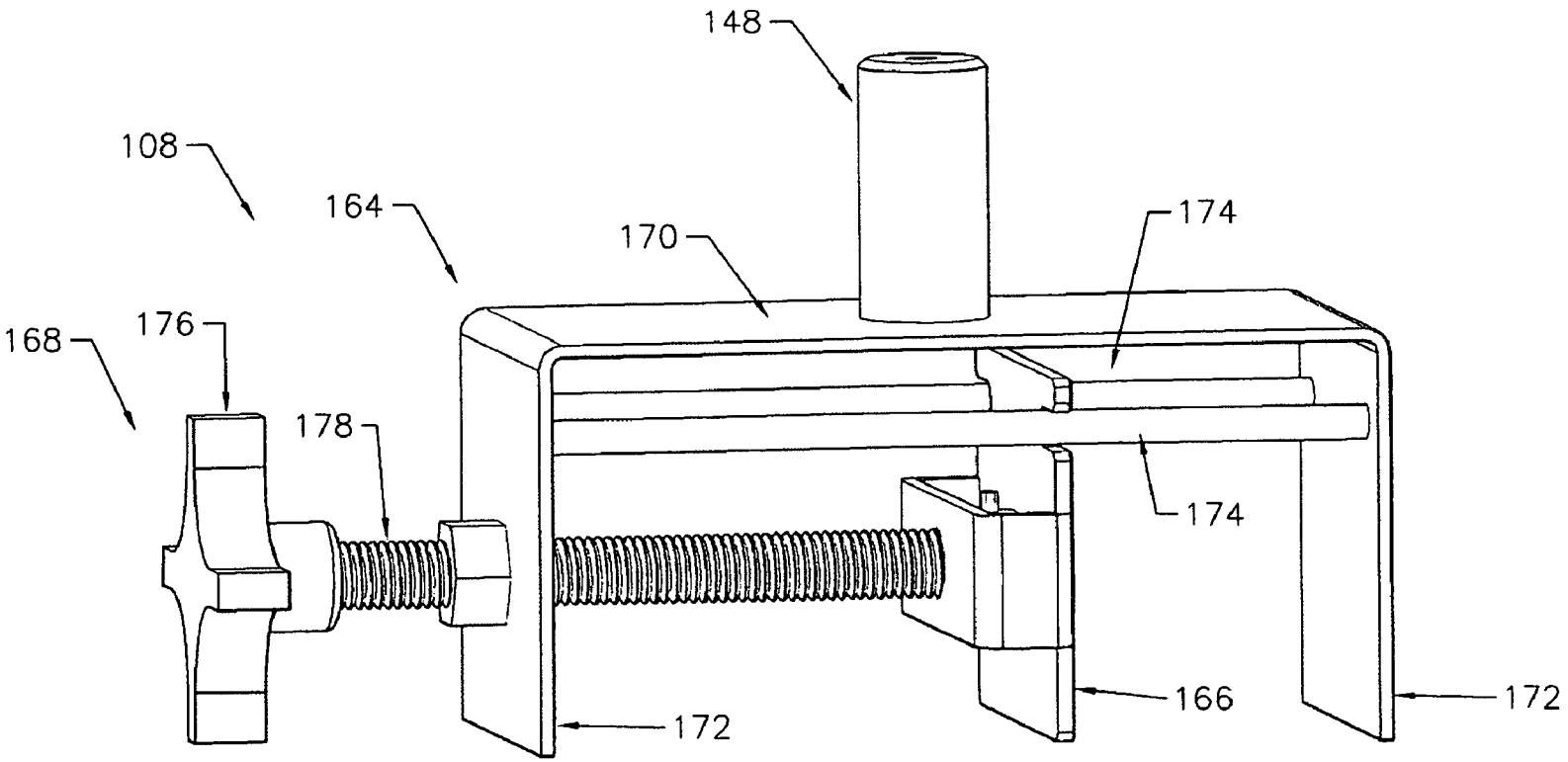
FIG. 5 is a partial perspective view of the gun vise shown in FIG. 1 illustrating an embodiment of a releasable mounting component.

As shown in FIG. 5, the fixed hub 148 may extend upward from the mounting component 108 and may be secured to the mounting component 108. The fixed hub 148 may have a relatively cylindrical outer surface. With reference back to FIG. 4, the adjustment hub 128 may be sized and shaped to mate with the fixed hub 148. The adjustment hub 128 may also be configured to rotate with respect to the fixed hub 148. For example, the adjustment hub 128 may be configured to rotate as much as 360 degrees with respect to the fixed hub 148. More specifically, the adjustment hub 128 may have a cylindrical inner surface of a slightly larger diameter than the cylindrical outer surface of the fixed hub 148.

The set screw 150 may include a knob 152 and a threaded shaft 154. The threaded shaft 154 may be sized to fit within a threaded channel 155 in the adjustment hub 128. The threaded channel 155 may extend through the adjustment hub 128 to the fixed hub 148. The threaded shaft 154 may be moved into and out of the threaded channel 156 by rotating the knob 152.

In use, the knob 152 may be rotated to loosen the set screw 150. The adjustment hub 128 then may be free to rotate about the fixed hub 148 in the horizontal direction. Rotating the adjustment hub 128 in the horizontal direction also may rotate the coupling component 102, because the coupling component 102 is coupled to the adjustment hub 128 via the flanges 130. When the coupling component 102 is in the desired horizontal orientation, the knob 152 may be rotated to tighten the set screw 150. The threaded shaft 154 may be rotated through the threaded channel 155 until an end of the set screw 150 firmly abuts the fixed hub 148. The coupling component 102 then may be maintained in the selected horizontal orientation.

In embodiments, the horizontal adjustment mechanism 106 may be configured to position the coupling component 102 at substantially any position in the horizontal direction. For example, in embodiments in which the adjustment hub 128 can rotate substantially 360 degrees with respect to the fixed hub 148, the horizontal adjustment mechanism 106 can be adjusted to position the coupling component 102 at substantially any position in the horizontal direction.

The gun vise 100 further includes a mounting component suited for securely associating the gun vise 100 with a mounting surface, such as a rail on a deck or a hunting stand. Four embodiments of mounting components are described below with reference to FIGS. 5-8, although other configurations are possible. So that the gun vise 100 may be used with any mounting component, each mounting component may include a fixed hub 148, and the adjustment hub 128 may be removably associated with the fixed hub 148. Therefore, the gun vise may be interchangeably used with any of a number of mounting components by removing the adjustment hub 128 from the fixed hub 148 associated with a first mounting component, such as the mounting component 108 shown in FIG. 5, and placing the adjustment hub 128 on a fixed hub 148 associated with a second mounting component, such as the mounting component 608 shown in FIG. 6, the mounting component 708 shown in FIG. 7, or the mounting component 808 shown in FIG. 8.

For example, the fixed hub 148 may have a hole, as shown in FIG. 4, for receiving a fastener 162, as shown in FIG. 3. The fastener 162 may have a relatively large head that extends over the adjustment hub 128. The fastener 162 may generally prevent the adjustment hub 128 from moving in the vertical direction with respect to the fixed hub 148, but the fastener 162 may permit the adjustment hub 128 to rotate about the fixed hub 148 in the horizontal direction. The fastener 162 also may be removed, as shown in FIG. 4, so that the adjustment hub 128 may be completely removed from the fixed hub 148, as shown in FIG. 5. Thereafter, the adjustment hub 128 may be placed on another mounting component, such as the mounting component 608 described below with reference to FIG. 6, to mount the coupling component 102, the vertical adjustment mechanism 104, and the horizontal adjustment mechanism 106 to the other mounting component.

FIG. 5 is a perspective view of a releasable mounting component 108 of the gun vise 100. The releasable mounting component 108 may removably secure the gun vise 100 to a mounting surface. The releasable mounting component 108 may include a cap member 164 that is shaped for positioning over the mounting surface and a securing device 168 that adjusts a position of a securing plate 166 with reference to the cap member 164. The securing plate 166 may releasably secure the mounting surface between the cap member 164 and the securing plate 166, so that the gun vise 100 is impeded from moving.

As shown in the illustrated embodiment the cap member 164 may include a substantially planar upper surface 170 and two downwardly extending flanges 172. Note that the fixed hub 148 may project upward from the upper surface 170. The securing plate 166 may be positioned below the upper surface 170 between the flanges 172. For example, the securing plate 166 may be a substantially planar plate that is slidably mounted on a pair of rails 174. The securing device 168 may include a threaded shaft 178. The threaded shaft 178 may be coupled to a knob 176 on one end and the securing plate 166 on the other end. The threaded shaft 178 may extend through one of the flanges 172, with the knob 176 being positioned outside of the flanges 172 and the securing plate 166 being positioned between the flanges 172.

In use, the cap member 164 may be placed over the mounting surface. The securing device 168 may be tightened by rotating the knob 176, which repositions the threaded shaft 178 and therefore the securing plate 166 on the rails 174. The securing plate 166 may place a load on the mounting surface to secure the mounting surface between the securing plate 166 and the flange 172. To remove the mounting component 108 from the mounting surface, the knob 176 may be rotated to release the securing plate 166. Thereafter, the mounting component 108 may be adjusted to a different position on the mounting surface or the mounting component 108 may be positioned on another mounting surface altogether.

Figure 6:
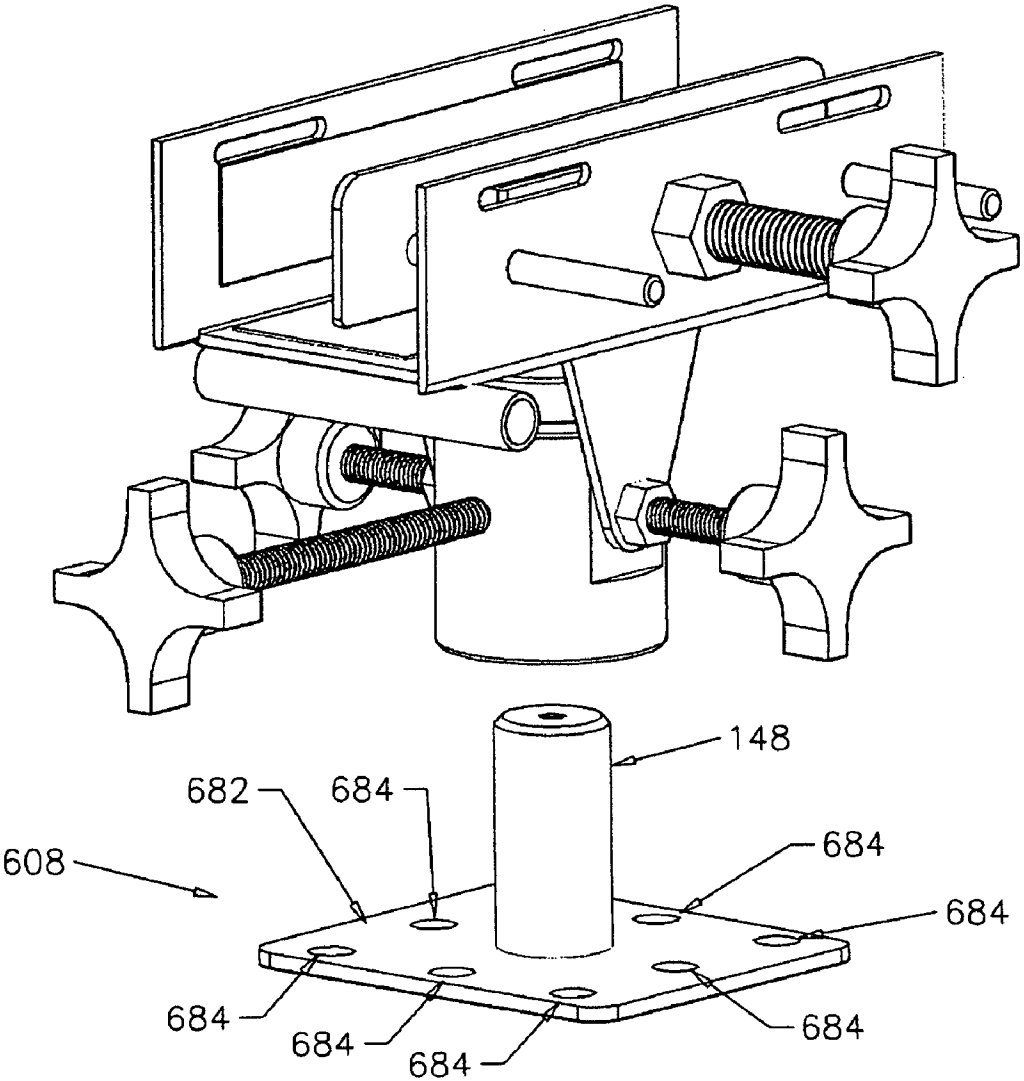
FIG. 6 is a perspective view of another embodiment of gun vise, illustrating another embodiment of a mounting component.

FIG. 6 is a perspective view of another embodiment of a mounting component 608 that may be used with the gun vise 100. The mounting component 608 may be relatively permanently affixed to the mounting surface, such as a railing on a deck or a hunting stand. As shown, the mounting component 608 generally includes a plate 682 having a plurality of bores 684. To mount the mounting component 608 to the mounting surface, the plate 682 may be placed on the mounting surface and fasteners such as bolts may be placed through the bores 684. As shown, a fixed hub 148 may extend upward from the plate 682, so that the gun vise may be associated with the mounting component 608.

Figure 7:
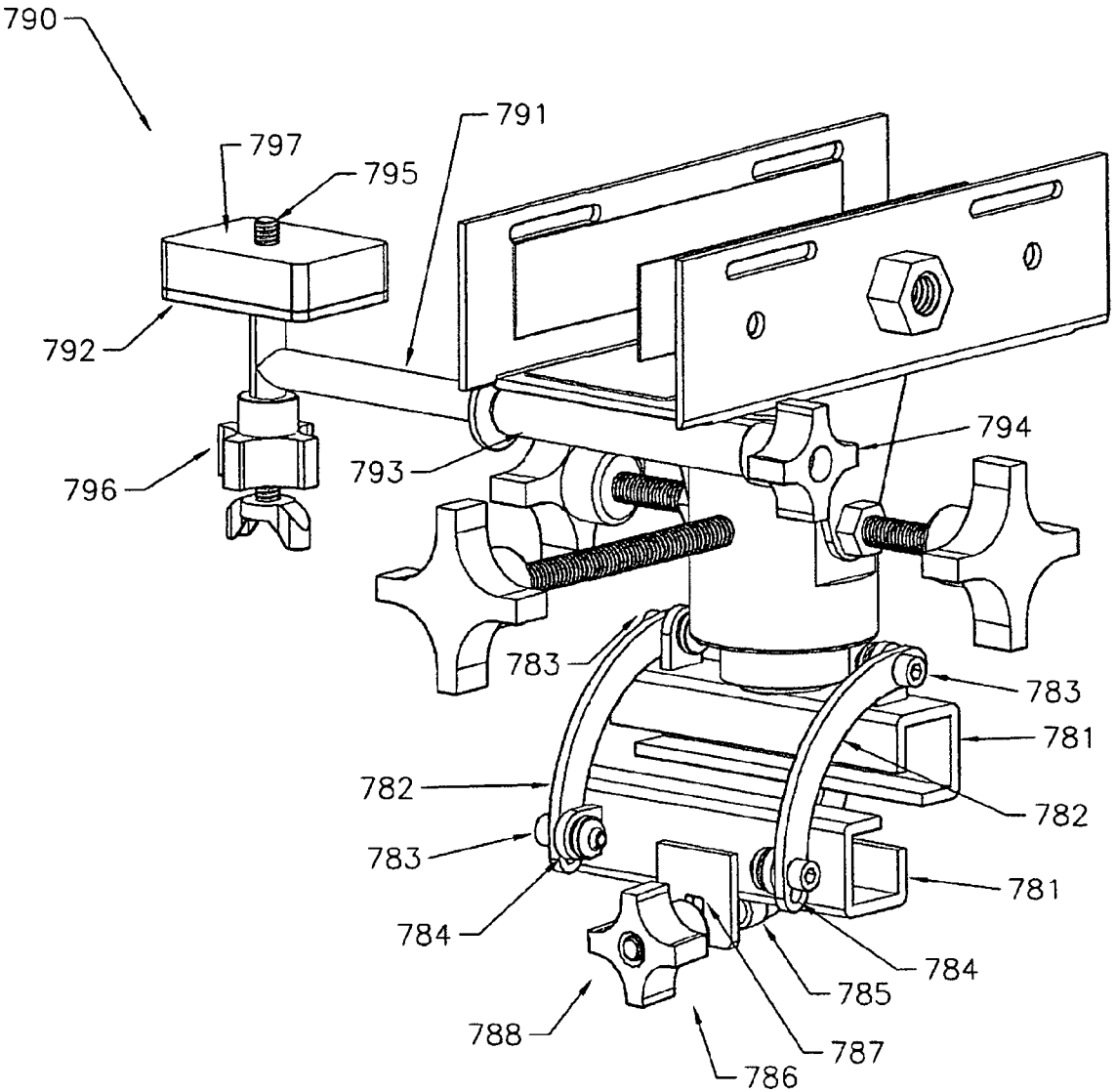
FIG. 7 is a perspective view of another embodiment of gun vise, illustrating another embodiment of a mounting component and illustrating an embodiment of a camera or spotting scope attachment.

FIG. 7 is a perspective view of another embodiment of a mounting component 708 that may be used with the gun vise. The mounting component 708 may be suited for releasably attaching the gun vise to a railing. For example, the mounted component 708 may be securely attached to a cylindrical railing, a square-shaped railing, or a railing of any other cross-sectional shape. Therefore, the mounting component 708 may be considered a railing attachment for use with a variety of railings, such as the type of railings commonly found on deer stands and ladder stands.

As shown, the mounting component 708 may include a number of tubular clamping members 781. The tubular clamping members 781 may be coupled together about one side of the mounting component 708 by one or more arc-shaped connectors 782. The clamping members 781 may be associated with the arc-shaped connectors 782 via pivot pins 783, which permit the clamping members 781 to pivot with reference to the arc-shaped connectors 782. Each arc-shaped connector 782 may have multiple pivot holes 784 so that the radius formed by the clamping members 781 may be adjusted by moving the pivot pins 783 among the pivot holes 784. On an opposite side of the mounting component 708, a releasable arc-shaped connector 785 may be pivotably associated with one of the clamping members 781 and may be releasably securable to the other clamping member 781 via a releasable lock 786. For example, the releasable lock 786 may include a slotted tab 787 and a knob 788, although other configurations are possible. Once the mounting component 708 is associated with the railing, the gun vise may be placed on a fixed hub 148 extending upward from one of the clamping members 781.

FIG. 7 also illustrates an embodiment of a camera or in scope attachment 790, which may be used with any embodiment of the gun vise. The camera or spotting scope attachment 790 may be configured to couple a device such as a camera, a video camera, or a spotting scope to the coupling component. Thereby, movement of the coupling component may cause associated movement of the camera, video camera, or spotting scope. Thereafter the aim of the camera or spotting scope may be automatically repositioned in association with the aim of the gun.

As shown, the camera or spotting scope attachment 790 may include an L-shaped member 791 that extends between the coupling component and a platform 792. For example, the L-shaped member 791 may extend through a channel 793 on the coupling component as shown. A knob 794 on an end of the L-shaped member 791 may releasably secure the camera or spotting scope attachment 790 to the gun vise. On an opposite end, the platform 792 may have a universal mount 795 adapted for securely engaging a standard threaded hole on the camera or spotting scope. For example, the threaded hole may be a tripod mount of a video camera. An adjustment knob 796 may permit adjusting the direction of the platform 792, and therefore any associated camera or spotting scope. Together, the knob 794 and the adjustment knob 796 may permit repositioning the camera through a full range of motion. A cushioning pad 797 may be positioned on the platform 792 to dampen the vibrations associated with firing the gun.

In use, the camera or spotting scope attachment 790 may be associated with the gun vise and the knobs 794, 796 may be tightened to secure the platform 792 in the selected position. A camera or spotting scope then may be attached to the universal mount 795. Thereafter, the vertical and horizontal adjustment mechanisms may be used to reposition the coupling component, and therefore the aim of the gun. Such repositioning may simultaneously reposition the aim of the camera or spotting scope, so that the aim of the camera remains in sync with the aim of the gun. It should be noted that the camera or spotting scope attachment 790 may be used with any embodiment of the gun vise. Further, the camera or spotting scope attachment 790 may be reversed in orientation to facilitate right-handed or left-handed use.

Figure 8:
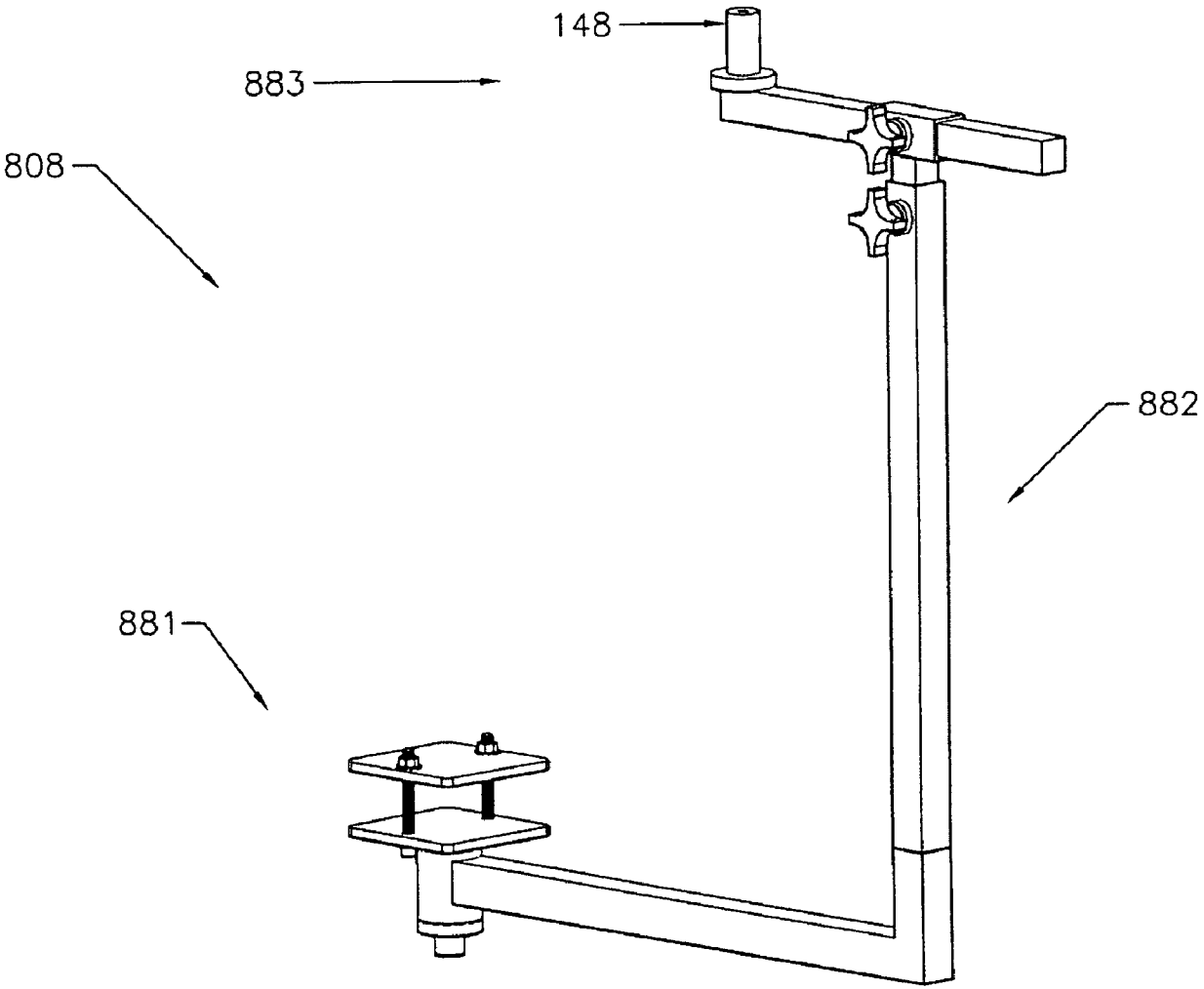
FIG. 8 is a perspective view of another embodiment of a mounting component that may be used with an embodiment of a gun vise, such as the gun vise shown in FIG. 1.

FIG. 8 is a perspective view of another embodiment of a mounting component 808. The mounting component 808 may enable relatively large scale adjustment of the gun vise in at least a vertical direction. For example, the mounting component 808 may be configured to telescope in the vertical direction. Such a mounting component 808 may be used to mount the gun vise to a deer stand.

As shown, the mounting component 808 may include a clamp 881 and a swing arm 882. The clamp 881 may be adapted for associating the mounting component 808 with the deer stand. For example, the clamp 881 may be secured to the floor of the deer stand. The swing arm 882 may have a vise mounting portion 883 adapted for receiving the gun vise. For example, a fixed hub 148 may be positioned on the vise mounting portion 883. The swing arm 882 may be vertically and horizontally adjustable. For example, the swing arm 882 may include telescoping members and associated knobs for securing the telescoping members in selected positions. The swing arm 882 also may be permitted to rotate with reference to the clamp 881.

In use, the mounting component 808 may be mounted to the deer stand using the clamp 881, and the gun vise may be positioned on the vise mounting portion 883. The swing arm 882 may be rotated and vertically and horizontally adjusted so that the gun is comfortably accessible to the hunter. For example, the hunter may adjust the mounting component 808 so that the gun is accessible when the hunter is in a seated position.

The components of the gun vise may be made from a relatively lightweight yet sturdy material. Using a lightweight material facilitates transporting the gun vise, while using a sturdy material facilitates supporting the recoil associated with firing the gun. One example material that may be used is aluminum, although other materials may be used in a range of combinations.

In embodiments, the gun vise may be configured for relatively complete disassembly. Such a configuration may facilitate cleaning the gun vise. Further, such disassembly may permit coating one or more components of the gun vise with a film. For example, dip transfer technology may be employed to coat the gun vise with a film bearing, for example, a camouflage pattern.

The gun vise may facilitate aiming and firing a gun. Specifically, the gun vise may be mounted to the mounting surface using a mounting component. Once the gun vise is so secured, the gun may be coupled to the coupling component of the gun vise. The aim of the gun may be varied using the vertical and horizontal adjustment mechanisms. The vertical and horizontal adjustment mechanisms may be operated with relatively few hand movements, so that the aim of the gun may be varied relatively quickly in response to movement of the target. Once the gun is aimed, the vertical and horizontal adjustment mechanisms may be tightened. Thereafter, the aim of the gun may be maintained as the shot is fired, and the shooter may not experience the impact of the gun against his body, because the gun may be securely mounted to the mounting surface.

While particular embodiments of an adjustable gun vise have been disclosed in detail in the foregoing description and figures for purposes of example, those skilled in the art will understand that variations and modifications may be made without departing from the scope of the disclosure. All such variations and modifications are intended to be included within the scope of the present application, as protected by the following claims.

At least the following is claimed:

1. A gun vise for adjustably holding a gun on a mounting surface, the gun vise comprising:

a coupling component configured to secure the gun vise to the gun;

a mounting component configured to secure the gun vise to the mounting surface;

a horizontal adjustment mechanism configured to adjust an orientation of the coupling component in a first plane; and a vertical adjustment mechanism configured to adjust an orientation of the coupling component in a second plane, the second plane being a substantially vertical plane that is transverse to the first plane, the vertical adjustment mechanism comprising:

a hub associated with the mounting component:

at least one flange associated with the coupling component, the flange being permitted to rotate with reference to the hub in the substantially vertical plane to vary the orientation of the coupling component with reference to the mounting component in the substantially vertical plane; and a tightening device configured to releasably secure the flange against the hub to maintain the orientation of the coupling component in the substantially vertical plane.

2. The gun vise of claim 1, further comprising an attachment configured for attaching one of the following to the gun vise: a video camera or a spotting scope, such that movement of the coupling component is transferred to the camera or the spotting scope.

3. The gun vise of claim 1, wherein:

the horizontal adjustment mechanism is configured to rotate the coupling component in the first plane; and the vertical adjustment mechanism is configured to rotate the coupling component in the second plane.

4. The gun vise of claim 3, wherein the horizontal and vertical adjustment mechanisms are configured to rotate about a common point of rotation.

5. The gun vise of claim 1, wherein the first plane is a substantially horizontal plane.

6. A gun vise for adjustably holding a gun on a mounting surface, the gun vise comprising:

a coupling component configured to secure the gun vise to the gun;

a mounting component configured to secure the gun vise to the mounting surface;

a horizontal adjustment mechanism configured to adjust an orientation of the coupling component in a first plane, the first plane being a substantially horizontal plane, the horizontal adjustment mechanism comprising:

a fixed hub associated with the mounting component:

an adjustment hub associated with the coupling component, the adjustment hub being permitted to rotate about the fixed hub in the substantially horizontal plane to vary the orientation of the coupling component with reference to the mounting component in the substantially horizontal plane;

a set screw configured to secure the adjustment hub against the fixed hub to maintain the orientation of the coupling component in the substantially horizontal plane; and a vertical adjustment mechanism configured to adjust an orientation of the coupling component in a second plane, the second plane being transverse to the first plane.

7. The gun vise of claim 6, wherein the second plane is a substantially vertical plane.

8. The gun vise of claim 6, further comprising an attachment configured for attaching one of the following to the gun vise: a video camera or a spotting scope, such that movement of the coupling component is transferred to the camera or the spotting scope.

9. The gun vise of claim 6, wherein:

the horizontal adjustment mechanism is configured to rotate the coupling component in the first plane; and the vertical adjustment mechanism is configured to rotate the coupling component in the second plane.

10. The gun vise of claim 9, wherein the horizontal and vertical adjustment mechanisms are configured to rotate about a common point of rotation.

11. A gun vise for adjustably holding a gun on a mounting surface, the gun vise comprising:

a coupling component configured to secure the gun vise to the gun;

a mounting component configured to secure the gun vise to the mounting surface, the mounting component comprising:

a plurality of tubular clamping members configured to be positioned about a railing, the tubular clamping members being pivotably attached to each other via a plurality of arc-shaped connectors;

a releasable lock configured to releasably secure the tubular clamping members about the railing;

a horizontal adjustment mechanism configured to adjust an orientation of the coupling component in a first plane; and a vertical adjustment mechanism configured to adjust an orientation of the coupling component in a second plane the second plane being transverse to the first plane.

12. The gun vise of claim 11, wherein the first plane is a substantially horizontal plane and the second plane is a substantially vertical plane.

13. The gun vise of claim 11, further comprising an attachment configured for attaching one of the following to the gun vise: a video camera or a spotting scope, such that movement of the coupling component is transferred to the camera or the spotting scope.

14. The gun vise of claim 11, wherein:

the horizontal adjustment mechanism is configured to rotate the coupling component in the first plane; and the vertical adjustment mechanism is configured to rotate the coupling component in the second plane.

15. The gun vise of claim 14, wherein the horizontal and vertical adjustment mechanisms are configured to rotate about a common point of rotation.

16. A gun vise system comprising:

a first mount configured to releasably attach to a railing, the first mount comprising a first gun vise adaptor:

a second mount configured to releasably attach to a deer stand, the second mount comprising a second gun vise adapter; and an adjustable gun vise comprising:

a support body configured to releasable hold a gun;

a first adjustor configured to adjust the support body in a first direction; and a second adjustor configured to adjust the support body in a second direction, the second direction transverse to the first direction; and a mount adapter configured to mate with the first gun vise adapter to releasably attach the gun vise to the first mount, and the mount adapter configured to mate with the second gun vise adapter to releasably attach the gun vise to the second mount.

17. The gun vise of claim 16, wherein the second gun vise adapter has substantially the same configuration as the first gun vise adapter.

18. The gun vise of claim 16, wherein:

the first adjustor is configured to adjust the support body in a first direction by adjusting the orientation of the support body in a substantially horizontal plane; and the second adjustor is configured to adjust the support body in a second direction by adjusting the orientation of the support body in a substantially vertical plane.

19. The gun vise of claim 16, further comprising an attachment configured for attaching one of the following to the gun vise: a video camera or a spotting scope, such that movement of the coupling component is transferred to the camera or the spotting scope.

20. The gun vise of claim 16, wherein:

the first adjustor is configured to rotate the support body in a first plane; and the second adjustor is configured to rotate the support body in a second plane.

21. The gun vise of claim 16, wherein the first and second adjustors are configured to rotate about a common point of rotation.

* * * * *